US005689865A

United States Patent [19]

Weber, III

[11] Patent Number: 5,689,865

[45] Date of Patent: Nov. 25, 1997

[54] CLAMPING DEVICE

[76] Inventor: Russell M. Weber, III, 1022 Gimblin St., St. Louis, Mo. 63147

[21] Appl. No.: 656,706

[22] Filed: Jun. 3, 1996

Related U.S. Application Data

[63] Continuation of Ser. No. 347,507, Nov. 30, 1994, abandoned.

[51] Int. Cl.[6] ..... A44B 21/00

[52] U.S. Cl. ..... 24/523

[58] Field of Search ..... 24/523, 115 G, 24/136 R, 171, 194, 712.5; 439/788, 817, 818; 248/316.4, 687

[56] References Cited

U.S. PATENT DOCUMENTS

| | | | |
|---|---|---|---|
| 1,185,348 | 5/1916 | Rutledge et al. | 24/523 |
| 1,254,172 | 1/1918 | Tefft | 439/817 |
| 1,455,839 | 5/1923 | Hamilton | 24/523 |
| 1,639,278 | 8/1927 | Wharton et al. | 24/115 G |
| 2,524,649 | 10/1950 | Buhler | 24/115 G |
| 3,253,340 | 5/1966 | Farnam | 24/115 G X |
| 3,262,670 | 7/1966 | Marlett | 24/115 G X |
| 4,878,269 | 11/1989 | Anscher et al. | 24/115 G |
| 5,008,981 | 4/1991 | Smithson | 24/115 G X |

FOREIGN PATENT DOCUMENTS

| | | | |
|---|---|---|---|
| 1276059 | 10/1961 | France | 24/115 G |
| 727380 | 3/1955 | United Kingdom | 439/817 |

*Primary Examiner*—James R. Brittain

*Attorney, Agent, or Firm*—Banner & Witcoff, Ltd.

[57] ABSTRACT

An improved damping assembly is provided, comprising a housing, a spring, a pressure plate, and an actuator integral to the pressure plate. The housing is made up of first and second outer plates spaced apart from one another by a plurality of spacers. The pressure plate is positioned inside the housing, and is freely movable within the housing between the inner surface of the first and second outer plates by pressure exerted against the actuator. The spring is positioned between the pressure plate and the inner surface of the first plate, thus urging the pressure plate towards the inner surface of the second plate. An object, inserted into the housing between the pressure plate and the second plate, is held in place between the pressure plate and the second plate.

2 Claims, 2 Drawing Sheets

CLAMPING DEVICE

This application is a continuation of application Ser. No. 08/347,507, filed Nov. 30, 1994, now abandoned.

BACKGROUND OF THE INVENTION

1. Field of the Invention

This invention relates generally to spring actuated clamping devices. More particularly, the invention relates to a spring actuated clamp assembly that is mountable against a flat surface, for suspending an object from that surface.

2. Discussion of the Prior Art

Different types of clamps have been developed over the years, for use in many different applications. The prior art includes clamps that can be mounted against a surface, to hold an object in place against the surface. For example, clothespin-type clamps have been attached to magnets, so they can be mounted against a metal surface, such as a refrigerator, to hold objects in place. Alternatively, various types of clamps or clips have been fixed to non-magnetic mounting plates, which are then fastened to a wall with an adhesive or with fasteners.

With typical mounted clamps, the clamp is actuated by pressing on one end of the clamp, causing jaws at the other end of the clamp to open to receive an object. However, since the force that actuates the clamp is applied at one end of the clamp, rather than at the center of the clamp, there is a tendency for the other end of the clamp to pull away from the surface upon which the clamp is mounted. If the surface is covered with a coat of paint, or with a thin laminate, the paint or laminate can actually be pulled away from the underlying surface when the clamp is actuated, damaging the surface.

Accordingly, there is a need for a clamp that can be easily mounted onto a surface, in which the force that is used to actuate the clamp does not cause the clamp to pull or twist away from the surface. The clamp should be lightweight, inexpensive, and easy to manufacture and install. The clamp should also be capable of receiving multiple objects independently. These and a number of additional objectives are met through the present invention.

SUMMARY OF THE INVENTION

The present invention is an improved spring actuated mountable clamp, that is useful for hanging an object onto a surface. While the clamp can be used in a number of different applications, it is particularly useful in situations where relatively light objects are to be suspended from a surface, for instance, to hang wet towels or clothing in a boat, to prevent them from blowing away.

In a basic aspect, the invention comprises a housing, a spring, a pressure plate and an actuator for actuating the pressure plate. The housing is made up of first and second outer plates spaced apart from one another by a plurality of spacers. The pressure plate is positioned inside the housing, freely movable within the housing between the inner surface of the first and second outer plates. The actuator is integral to the pressure plate, and extends out of the housing from the pressure plate. The actuator can take the form of one or more tabs that extend from the sides of the housing, or a button that extends from the pressure plate through the second outer plate. The spring is positioned between the pressure plate and the inner surface of the first plate, thus urging the pressure plate towards the inner surface of the second plate. An object, inserted into the housing between the pressure plate and the second plate, is held in place between the pressure plate and the second plate.

When the actuator is pressed manually, the pressure plate is forced away from the inner surface of the second outer plate, creating a space between the pressure plate and the second outer plate into which an object can be inserted. When the pressure against the actuator is released, the spring acts to bias the pressure plate towards the inner surface of the second plate, gripping the object in place between the pressure plate and the inner surface of the second outer plate.

DESCRIPTION OF THE PREFERRED EMBODIMENTS

Figure 1:
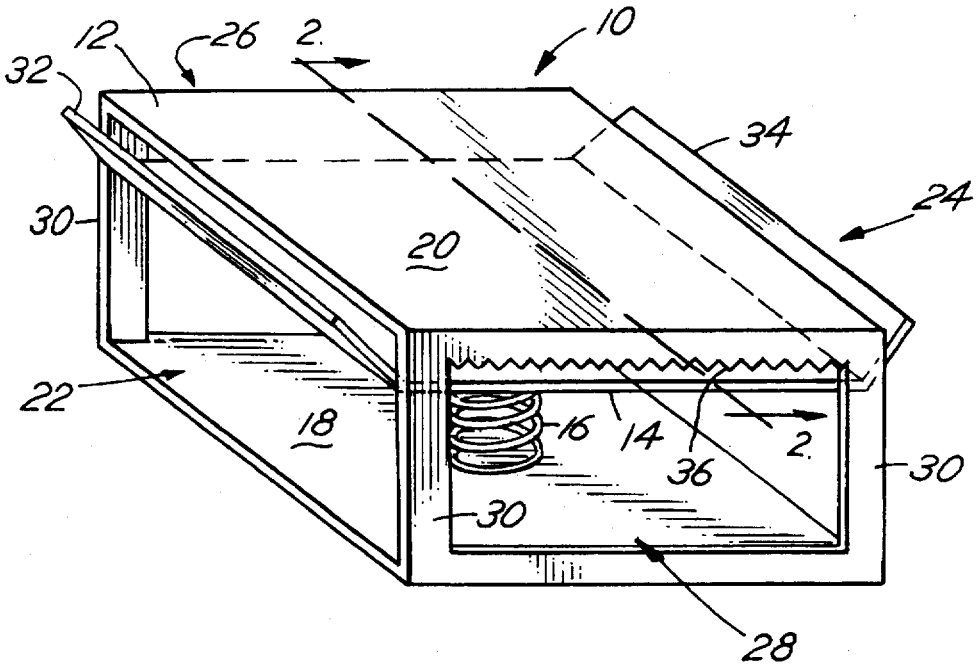
FIG. 1 of the drawing is a perspective view of a preferred embodiment of the claimed invention.

Referring now to the drawings, and in particular to FIGS. 1–4 thereof, details of various preferred embodiments are addressed.

As shown in FIG. 1, a preferred embodiment of the apparatus 10 comprises a housing 12, a pressure plate 14, and a spring 16. The housing is generally box-shaped, and is made up of first and second outer plates, 18 and 20, respectively, separated from one another along side edges 22, 24, 26 and 28 by a plurality of spacers or edge panels 30. The first and second plates are preferably parallel to one another. The distance between the first and second plates can vary, depending on the size and thickness of whatever objects are to be inserted into the clamp. For a typical clamp used to hang small objects, such as a wet towel, a separation between the plates of approximately ¾–1 inch has been found to work well. However, much larger clamps can be used as circumstances dictate.

Figure 2:
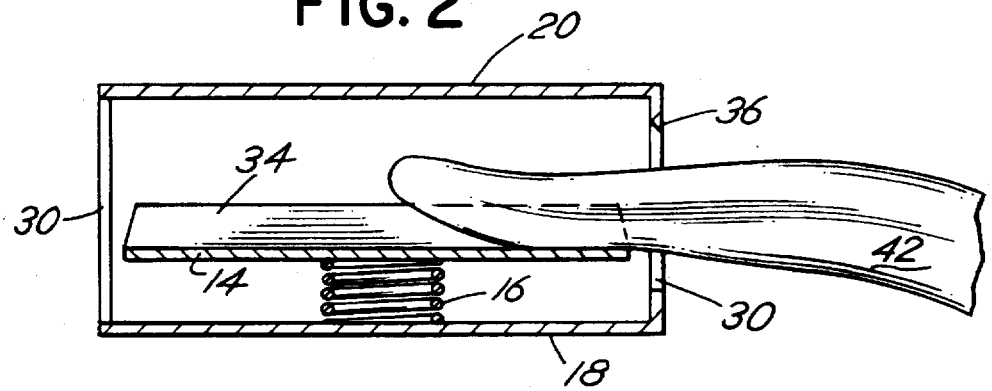
FIG. 2 of the drawing is a cross section view of the embodiment shown in FIG. 1, taken along the line 2—2, with the pressure plate in the retracted position, to allow introduction of an object into the clamp.
Figure 3:
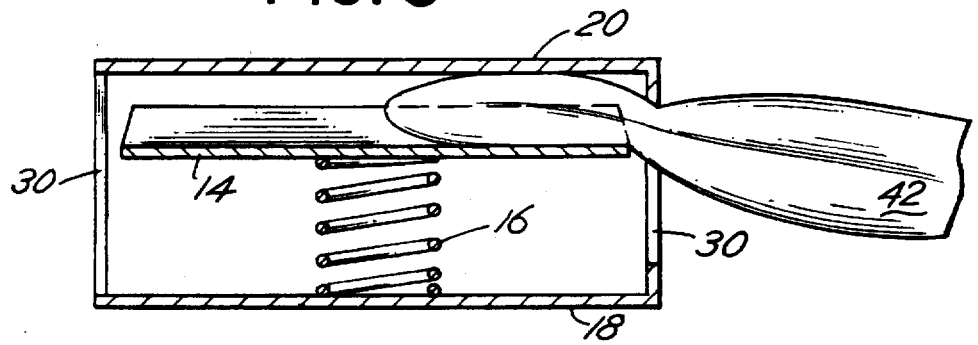
FIG. 3 of the drawing is a cross section view similar to that in FIG. 2, with the pressure plate in the advanced position, to hold an object in the clamp.
Figure 4:
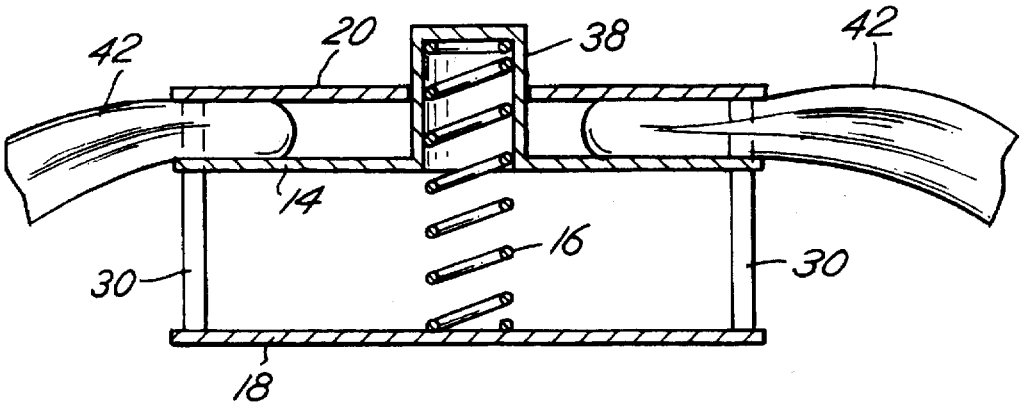
FIG. 4 of the drawing is a similar cross sectional view of another preferred embodiment, in which a button extends from the pressure plate through a hole in the center of the second outer plate, to allow actuation of the clamp.

The spacers may be thin columns or pins connected to adjacent corners of the opposing plates. Alternatively, the spacers may be panels that extend along an edge of the housing between the first and second plates. However, side panels should not be used along edges where the pressure plate extends out of the housing, to the extent they inhibit movement of the pressure plate, or interfere with the ability to insert an object into the housing through at least one of the edges of the housing. Accordingly, where side panels are used to separate the first and second panels, the side panels should have openings as needed to allow an object 42 to be inserted into the clamp, as shown in FIGS. 2–4, and to allow movement of the pressure plate within the housing. In the embodiment shown in FIGS. 1–3, edge panels 30 are shown. In FIG. 4, thin columns 30 are shown, extending between the corners of the first and second plates.

The pressure plate 14 is positioned within the housing between the first and second plates, generally parallel to the plates. The pressure plate is preferably flat, and is freely movable within the housing between the inner surfaces of the first and second plates, along an axis that is perpendicular to those inner surfaces. An actuator, preferably integral with the pressure plate, extends out of the housing through at least one side edge of the housing, but preferably through two opposite side edges 22 and 24, and is bent slightly away from the primary plane of the pressure plate to form tabs 32 and 34. The tabs are easily accessible to a users fingers, allowing the pressure plate to be actuated with one hand, to compress the spring 16 and force the pressure plate away from the second outer plate 20. The tabs also provide structural rigidity to the pressure plate, and help maintain the lateral position of the pressure plate within the housing.

The spring 16 is positioned inside the housing, between the first plate 18 and the pressure plate 14, thereby urging the pressure plate towards and against the inner surface of the second plate 20. As used herein, the term spring is not limited to a standard coiled spring, and includes any component that may be used to exert a force against the pressure plate from within the housing, either in compression or tension, to urge the pressure plate towards the inner surface of the second plate. For instance, the spring might be a compressible rubber insert, a bent piece of spring steel, or in larger industrial clamps, a hydraulic piston. Preferably, the spring is in compression, pushing against the pressure plate. However, in an alternate embodiment, the spring can be positioned between the pressure plate and the inner surface of the second plate, in tension, so that the spring tends to pull, rather than push, the pressure plate 14 towards the second outer plate 20.

The second outer plate 20 can include serrations 36 along one or more of its outer edges, to help grip an object that is inserted between the pressure plate and the first outer plate. Alternatively, the serrations can be incorporated into the outer edges of the pressure plate 14.

Turning to FIG. 4, an alternate embodiment of the invention is shown, in which the actuator takes the form of a button 38 formed in the top of the pressure plate 14. The button extends through a hole 40 that passes through the center of the second plate 20. In this embodiment, the pressure plate 14 is actuated by pressing the button 38 with a single finger. The button 38 has a counterbore 40 for receiving one end of the spring 16. This helps maintain the position of both the spring 16 and the pressure plate 14 within the housing 12. As shown in FIG. 4, multiple objects 42 can be held in the clamp at the same time along different edges of the clamp.

Figure 5:
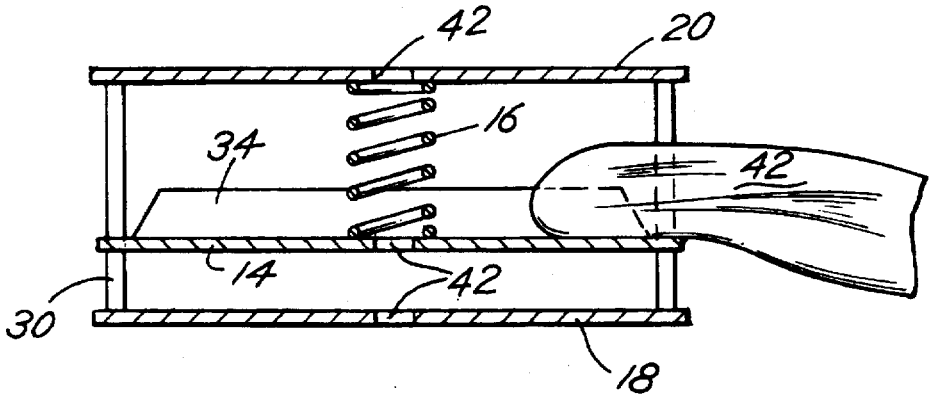
FIG. 5 of the drawing is a similar cross section view of an embodiment wherein the spring acts in tension, rather than compression.

The device can be mounted against a surface, or can be unmounted. For mounting the clamp onto a surface, an adhesive backing can be applied to the outer surface of the first plate. Alternatively, a mounting screw can be passed through a series of aligned holes 42 in the first plate, the second plate and the pressure plate, passing completely through the device, as shown in FIG. 5. A screw is inserted through the holes, passing through the center of the spring 16, and is screwed into whichever surface the clamp is to be mounted against. For mounting the clamp against a metallic surface, a magnet can be affixed to the outer surface of the first plate 18. The device can also be mounted using suction cups, plastic clips, or other such means.

The device, or individual components thereof, can be made of any of a number of different materials, including aluminum, nylon or injection molded plastic.

The claimed device can be used in a number of different situations. For instance, the clamp can be affixed to an interior surface of a boat, allowing towels or articles of clothing to be hung to dry, without blowing away. The clamp can also be used in a workshop to hang tools or other such items. For these applications, a relatively small clamp would be most suitable. For heavier uses, a larger clamp with a stiffer spring would be most suitable. It should be understood that the same principles and benefits discussed above would apply regardless of the size of the clamp.

The clamp has a number of benefits over previously known devices. First, the resultant forces on the clamp during actuation of the clamp are generally directed straight into the surface upon which the clamp is mounted, through the center of the clamp. This avoids or reduces the tendency for the clamp to twist away from the surface upon which it is mounted when the clamp is actuated. At the same time, the clamp can be easily actuated by one hand.

The clamp is also capable of holding more than one object. For instance, in the embodiment shown in FIG. 4, each of the four edges of the clamp can receive a different object, so that as many as four or more different objects can be held in the clamp at one time.

The foregoing examples are illustrative of various particularly preferred embodiments of the invention. However, they are not intended to limit the scope of the invention, and it will be understood to persons of skill in the art that various modifications to these embodiments may be made without departing from the true scope and spirit of the invention that is claimed below.

I claim as my invention:

1. A clamp assembly for retaining a towel or similar non-rigid article said assembly comprising, in combination:

a) a housing having first and second opposed, generally rectangular, parallel spaced housing plates, said plates being substantially congruent and having a substantially identical length and width, said plates having four corners, said plates being connected one to the other at each of the corners by a connecting spacer at each corner to thereby define lateral openings between the plates along every side thereof so as to provide first and second pairs of opposed openings, the first one of said pair of opposed openings along the length edges of the opposed spaced plates including depending gripping serrations extending from an edge of said first plate toward the other, second spaced plate;

b) a pressure plate having a generally rectangular shape and defined by a length and width, the length being greater than the length of the housing plate length and the width being less than the housing plate width, said pressure plate defining a plane and being positioned intermediate the housing plates and generally parallel to said housing plates, said pressure plate retained along its width between the housing plates by the corner spacers, said serrations extending over the side of the pressure plate along its width;

c) a compression spring positioned between the second one of the housing plates and the pressure plate for biasing the pressure plate to the other, first housing plate and in a direction toward the serrations on the other, first housing plate, said spring positioned generally at the mid-point of the plates; and d) said pressure plate including tabs integrally formed across the width and at the opposite sides of the length dimension of the pressure plate, said tabs extending upwardly from the plane of the pressure plate toward the first pressure plate and positioned for manual actuation and movement of the pressure plate against the force of the spring whereby an article may be positioned between the pressure plate and the first housing plate except for the upwardly-extending tabs and the serrations.

2. A method for retaining a towel or similar non-rigid article, comprising the steps of providing a clamp assembly said clamp assembly comprising, in combination:

a) a housing comprising first and second opposed, generally rectangular, parallel spaced housing plates, said plates being substantially congruent and having a substantially identical length and width, said plates having four corners, said plates being connected one to the other at each of the comers by a connecting spacer at each corner to thereby define lateral openings between the plates along every side thereof so as to define first and second pairs of opposed openings, the first one of said pair of opposed openings along the length edges of the opposed spaced plates, the first one of said plates including depending gripping serrations extending downwardly from an edge of said first, plate toward the other, second spaced plate;

b) a pressure plate having a generally rectangular shape and defined by a length and width, the length being greater than the length of the housing plate length and the width being less than the housing plate width, said pressure plate defining a plane and being positioned intermediate the housing plates and generally parallel to said housing plates, said pressure plate retained along its width between the housing plates by the corner spacers, said serrations extending over the sides of the pressure plate along its width;

c) a compression spring positioned between the second one of the housing plates and the pressure plate for biasing the pressure plate to the other, first housing plate and in a direction toward the serrations on the other, first housing plate, said spring positioned generally at the mid-point of the plates; and d) said pressure plate including tabs integrally formed across the width and at the opposite sides of the length dimension of the pressure plate, said tabs extending upwardly from the plane of the pressure plate toward the first pressure plate and positioned for manual actuation and movement of the pressure plate against the force of the spring; and maintaining said article positioned between the pressure plate, the first housing plate and the serrations whereby the pressure plate is retained within the area defined by the housing except for the upwardly extending tabs and whereby the flexible article is extended through the region between the pressure plate and first housing plate and simultaneously against the serrations.

* * * * *